United States Patent [19]

McMath, Jr.

[11] Patent Number: 4,648,965

[45] Date of Patent: Mar. 10, 1987

[54] RETORTING WITH SINTERED OR FUSED SOLIDS

[75] Inventor: Henry G. McMath, Jr., Houston, Tex.

[73] Assignee: Exxon Research and Engineering Company, Florham Park, N.J.

[21] Appl. No.: 729,335

[22] Filed: May 1, 1985

[51] Int. Cl.[4] ..... C10G 1/00

[52] U.S. Cl. ..... 208/411; 208/410; 208/427

[58] Field of Search ..... 208/11 R, 8 R, 410, 208/411, 427

[56] References Cited

U.S. PATENT DOCUMENTS

| | | | |
|---|---|---|---|
| 3,281,349 | 10/1966 | Evans | 208/11 R |
| 4,001,105 | 1/1977 | Gifford, II | 208/11 R |
| 4,101,412 | 7/1978 | Chei | 208/11 R |
| 4,125,453 | 11/1978 | Tamm et al. | 208/11 R |
| 4,227,990 | 10/1980 | Dearth et al. | 208/11 R |
| 4,312,740 | 1/1982 | Chiaramonte | 208/11 R |
| 4,392,942 | 7/1983 | Wallman et al. | 208/11 R |
| 4,415,432 | 11/1983 | York | 208/11 R |
| 4,459,201 | 7/1984 | Eakman et al. | 208/11 R |

OTHER PUBLICATIONS

Burnham, *Fuel*, vol. 58, pp. 719–723, 871–877, Sussex, England.

*Primary Examiner*—John Doll
*Assistant Examiner*—Lance Johnson
*Attorney, Agent, or Firm*—Wayne Hoover

[57] ABSTRACT

An improved process for retorting a solid carbonaceous material at elevated temperatures wherein a portion of the spent solids withdrawn from the retort is heated to a temperature within the range from about 1600° F. to about 2400° F. and then recycled to the retort as a source of heat at a temperature within the range from about 650° F. to about 1600° F. When the improved process of this invention is operated in this manner, the amount of liquid product obtained is maximized and the amount of gaseous product minimized. Moreover, the integrity of the particles thus recycled is improved and the amount of fines in the liquid product correspondingly reduced.

12 Claims, 2 Drawing Figures

FIGURE I

RETORTING WITH SINTERED OR FUSED SOLIDS

BACKGROUND OF THE INVENTION

This invention relates to an improved process for pyrolyzing or retorting solid carbonaceous materials. More particularly, this invention relates to an improved process for recovering liquid hydrocarbons from such solid carbonaceous materials.

As is well known, shale oil is not a naturally occurring product, but rather is formed by the pyrolysis, retorting or distillation of organic material, commonly called kerogen, found in certain shale-like rock. As is also well known, the kerogen has limited solubility in ordinary solvents and, therefore, cannot be recovered by extraction. Upon strong heating, however, the kerogen decomposes into gaseous and liquid products which can then be separated from the remainder of the shale-like rock. In general, the remainder of the shale-like rock will contain residual carbonaceous material, which may be burned to supply heat to the pyrolysis step, and various inorganic constituents which may impact upon the pyrolysis in varying degrees if recycled to the pyrolysis step.

Heretofore, several processes have been proposed wherein the heat required to effect the pyrolysis, retorting or distillation is supplied by introducing externally heated solids into the retorting apparatus. A particularly preferred solid material is spent shale, i.e., the remainder of the shale-like rock after the kerogen has been converted and separated, which has been burned to produce solid particles having a temperature within the range from about 50° to about 400° F. above the desired pyrolyzing, retorting or distillation temperature. These solids are then combined with the shale-like rock feed to the pyrolyzer, retort or distillation apparatus at a ratio within the range from about 0.5:1 to about 20:1.

As indicated in U.S. Pat. No. 4,459,201, processes wherein spent shale is combusted and recycled to the retort as a source of heat are known to exhibit disadvantages such as reduced yield of liquid product as a result of the adsorption of liquid by the recycled solids. These type processes are also known to result in large amounts of fines in the liquid product, apparently as a result of the poor particle integrity of the recycled solids. Moreover, it has been discovered that such processes exhibit a reduced yield of liquid product also as a result of conversion of the liquid to gases. This reduction in the yield of liquid product appears to be even more costly than that caused by adsorption of liquid product. The need, then, for an improved process wherein combusted, spent carbonaceous material can be used as a source of heat without a reduction in the yield of liquid product and an increase in the fines content in the liquid product is believed to be readily apparent.

SUMMARY OF THE INVENTION

It has now been discovered that the foregoing and other disadvantages of the prior art processes can be avoided or at least significantly reduced with the method of the present invention and an improved process for pyrolyzing, retorting or distilling solid carbonaceous materials provided thereby. It is, therefore, an object of this invention to provide an improved process for the pyrolyzing, retorting or distillation of solid carbonaceous material. It is another object of this invention to provide such a process wherein combusted, spent carbonaceous material is recycled to the pyrolyzing, retorting or distilling step without any significant loss in the yield of liquid product. It is still a further object of this invention to provide such a process wherein spent carbonaceous material is recycled to the pyrolyzing, retorting or distillation step without a significant increase in the fines content in the liquid product. The foregoing and other objects and advantages will become apparent from the description set forth hereinafter and from the drawings appended thereto.

In accordance with the present invention, the foregoing and other objects and advantages are accomplished by, first, pyrolyzing, retorting or distilling a solid carbonaceous material to produce at least a fluid product and a solid product containing residual carbon and inorganic material and thereafter heating the solid product to a temperature at which either sintering or fusion could occur prior to recycling the same to the pyrolyzing, retorting or distillation step. As used herein, the words "pyrolyzing, retorting and distillation" (in any tense) are used synonymously to mean a process step wherein a liquid hydrocarbon is produced, either as the result of physical separation or chemical conversion, from a solid material comprising both carbonaceous and inorganic components. For convenience, this step will hereinafter be referred to as a retorting step but to the extent there is a technical difference between pyrolyzing, retorting and distillation, the recitation "retorting" is intended to include all three. As pointed out more fully hereinafter, it is important that the heating of the solid product above its sintering or fusion point be accomplished in a manner so as to avoid agglomeration through sintering or fusion.

DETAILED DESCRIPTION OF THE INVENTION

Figure 1:
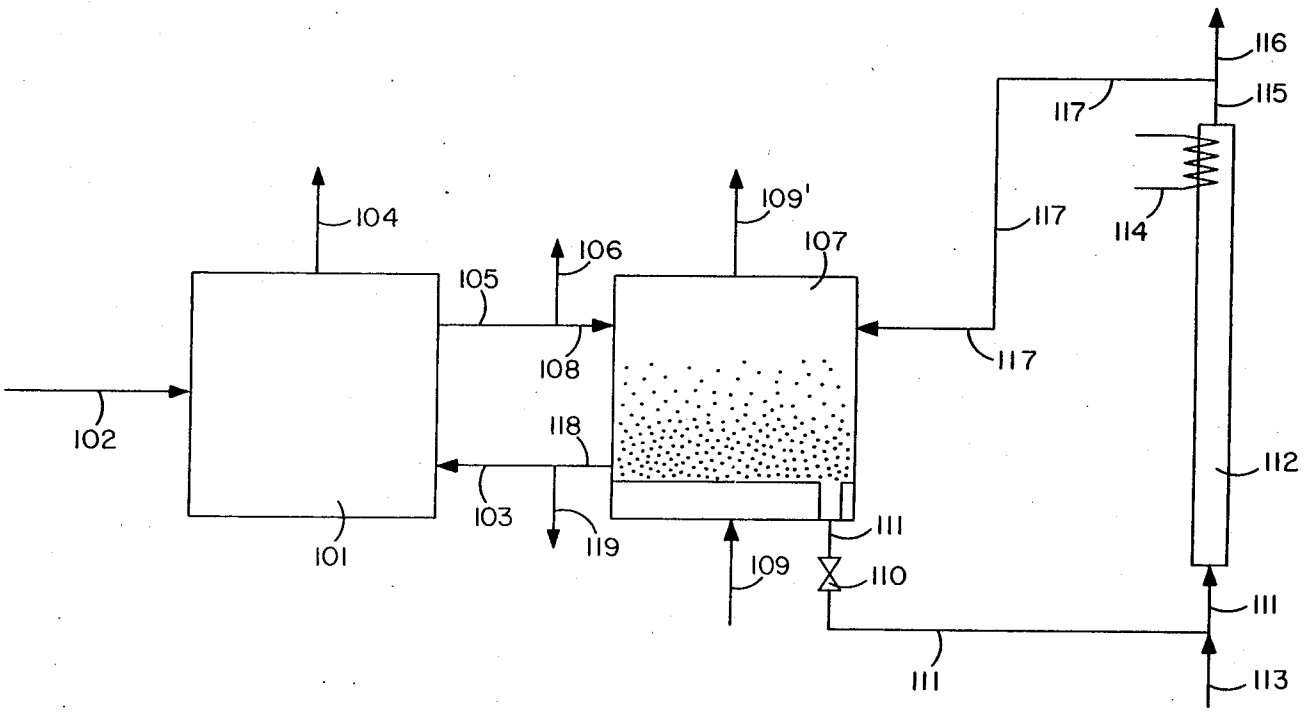
FIG. 1 is a schematic flow diagram of a process within the scope of the present invention wherein the solid product from the retort is first combusted and then heated to a temperature above its sintering or fusion temperature.

As indicated, supra, the present invention relates to an improved process for retorting solid carbonaceous materials to liberate or produce at least a liquid hydrocarbon product wherein a solid product comprising residual carbon and inorganic matter is heated and at least a portion thereof recycled to the retort as a source of heat. In accordance with the improved method of the present invention, at least a portion of the solid material which is recycled to the retort will be heated to a temperature above the sintering or fusion point of the inorganic material contained therein. As indicated more fully hereinafter, when at least a portion of the solids recycle is heated to a point above the sintering of fusion temperature, the yield of gaseous hydrocarbon is reduced and the yield of liquid hydrocarbons increased.

In general, the improved process of the present invention may be used in the retorting of any solid carbonaceous material containing significant quantities of catalytically active minerals such as montmorillonite, kaolinite, dolomite, illite, pyrite, carbonate, calcite, gypsum and the like. Suitable solid carbonaceous materials include shale rock, coal, lignite, anthracite, wood waste products, tar sands and the like.

While the inventor does not wish to be bound by any particular theory and while the inorganic materials noted above are said to be "catalytically active", it should be noted that these materials appear to exhibit catalytic cracking activity and the reduced liquid yield appears to result from the cracking of liquid to gas. It should also be noted while some of these inorganic materials are known to exhibit at least marginal catalytic cracking activity, some of the other materials, particularly carbonate, have not heretofore been known to exhibit such catalytic cracking activity. Notwithstanding this, increased gas yields and reduced liquid yields have been realized when materials containing these components have been recycled to a retorting operation. In this regard, it should be noted that most spend solid carbonaceous materials coming from a retorting operation have surface areas in the range from about 1 to about 50 $m.^2/g$. and when these materials are heated to a temperature above the sintering or fusion point the surface area is reduced to an amount within the range from about 0.0001 to about 2 $m.^2/g$. The increased yield of liquid product and the decreased yield of gaseous product is, then, believed to be directly associated with this reduction in surface area of the recycled solid materials.

In general, the solid carbonaceous materials to be retorted in the improved process of the present invention will be ground to a particle size within the range from about 0.7 to about 0.002 cm. In general, the retorting may be accomplished in a transfer line type retort, a fluidized bed, a screw type retort or any combination of these. In general, the actual particle size employed is not critical although shorter residence times would be required when smaller particles are employed. Moreover, more careful control of the particle size will be required in fluid bed operations to ensure the desired holding time within the fluid bed and smooth operation of the fluidized retort. In general, the retorting will be accomplished at a temperature within the range from about 300° to 600° C. and at a pressure within the range from about 0 to about 300 psig.

At the conditions employed in the retorting zone, the carbonaceous material is, generally, converted to a gaseous product, a liquid product, and a solids product. The product will comprise inorganic gases and low molecular weight hydrocarbons such as hydrogen, methane, propylene, pentadiene, and the like and will, in effect, be a distillate fraction having an initial boiling point of ambient temperature or less and a final boiling point within the range from about 10° to about 100° C., depending primarily upon the temperature and pressure employed in the retorting step. The liquid product will comprise a range of hydrocarbons and may also contain inorganic materials such as water, metal arsenides, ammonia and the like. The solid product will comprise residual hydrocarbons which may be the same or different in composition than was contained, originally, in the solid carbonaceous material and various inorganic components such as clay, carbonates and the like which were contained in the original feed and in any material recycled to the retorting step. Generally, the inorganic materials in the solid product will be chemically unchanged during the retorting step although hydrated compounds may be at least partially dehydrated at the conditions employed in the retort.

The various products may be separated into their respective phase using any suitable means known in the prior art. Suitable means include, but are not limited to, flashing, stripping, distillation, filtration and centrifugation. After the desired separation has been accomplished and, in accordance with the improved method of the present invention, at least a portion of the solid product will be heated to a temperature above the retort temperature and at least a portion of the thus-heated solid product will be recycled to the retort to provide at least a portion of the heat required therein. Also in accordance with the improved method of the present invention, at least a portion of the solid product will be heated to a temperature above the sintering of fusion temperature of the solid product so as to reduce the surface area thereof and correspondingly to reduce the catalytic cracking activity thereof and to enhance the particle integrity of the recycled material to thereby reduce the amount of fines produced during the retorting operation. In general, significant improvement will be realized by heating at least a portion of the solid product to a temperature above the sintering temperature thereof but maximum advantage will be realized when at least a portion of the solid product is heated to a temperature above the slagging or fusion temperature thereof. In those embodiments where at least a portion of the solid product is heated to a temperature above the fusion temperature of the inorganic material contained in the solid product, care must be exercised so as to at least minimize and preferably eliminate agglomeration. This can be most conveniently accomplished by effecting the heating in dilute phase such as can be achieved in a dilute phase transfer line heater. It should be noted, however, that in those cases where agglomeration does occur, the heated material may be ground prior to recycle to the retort.

In general, and when temperatures above about 1600° F. are desired, it will frequently be necessary to add an extraneous fuel at least to that portion of the solid product to be heated. The conditions employed in the retort, however, can be controlled to some extent so as to maximize the amount of residual carbon in the solid product thereby minimizing the amount of extraneous fuel that may be added. In general, any extraneous fuel may be added to the solid product to facilitate heating to the desired temperature. Alternatively, at least a portion of the solid product may be passed through a heater wherein an extraneous fuel is burned. Suitable fuels include coal, lignite, anthracite, fuel oil and natural gas. In a preferred embodiment, however, a portion of the gaseous product from retorting will be burned in a transfer line heater.

After the solid product has been heated to the desired temperature, it may be recycled directly to the retort or it may be combined with solid product at a different temperature prior to such recycle. In those cases where agglomeration has occurred, the recycle solid product may be combined with the solid carbonaceous material feed prior to the sizing thereof. Any surplus solid product may be withdrawn and discarded while the remaining product streams may be withdrawn directly as product or subjected to further upgrading to enhance their respective values.

It is believed that the present invention will be made even clearer by reference to the attached figures. Referring, then, to FIG. 1, an embodiment of the present invention wherein at least a portion of the spent solid carbonaceous material is first heated in a combustor and then all or portion of this is heated to a temperature above either the sintering or fusion temperature is illustrated. As indicated in the figure, a suitably sized carbonaceous material is fed to retort 101 through line 102. As indicated previously, the retort may be a transfer line retort, a fluidized bed, a screw-type retort or any combination of these retorts. In general, the retort will be operated at a temperature within the range from about 600° to about 1100° F. and at a pressure within the range from about 0 to about 300 psig. As also indicated in the figure, heat is supplied to the retort with hot solids entering through line 103. In the embodiment illustrated, the separation of gaseous and liquid product is, effectively, accomplished simply by flashing these products overhead from the retort. The product thus flashed overhead will comprise all materials having a boiling point equal to or lower than the temperature actually used in the retort at the pressure thereof. Also, and while not illustrated, in those embodiments where the retort is a fluid bed operation, the fluidizing gas will also act as a stripping gas and will be withdrawn overhead through line 104. When the retort is actually a fluidized bed, then, and due to the stripping action of the fluidizing gas, the overhead product will, generally, contain products boiling above the temperature employed in the retort. These products may be subjected to further separation in downstream processing as desired and all in accordance with technology well-known in the prior art. When the retort 101 is a fluidized bed, the fluidizing gas may be separated from the products withdrawn overhead and recycled to the retort.

In the embodiment illustrated, the solid product from the retorting step which includes hot solids introduced through line 103 is withdrawn through line 105. Any surplus solid product may be withdrawn through line 106 or line 119 and the remainder passed to heater 107 through line 108. In the embodiment illustrated, the heater is illustrated as a fluid bed heater and, while other type heaters may be employed, maximum operating efficiency will be realized when the heater is operated as a fluidized bed. In the heater 107, the solid product may be heated to a temperature within the range from about 50° F. to about 400° F. above the temperature of the retort. The heating may be accomplished by burning the residual carbon contained in the solid product with oxygen introduced with any suitable fluidizing gas through line 109. Suitable fluidizing gases are known in the prior art and any of these known gases may be used to fluidize the solid material in heater 107. A particularly effective fluidizing gas is a mixture of air and steam, the amount of air being sufficient to provide enough oxygen for complete combustion of the residual carbon contained in the solid product as well as any extraneous fuel that might be added to the heater through line 109. Unconverted fluidizing gas and gaseous combustion products may be withdrawn through line 109'.

In general, the heater will be operated at a temperature within the range from about 650° F. to about 1600° F. Generally, temperatures within this range may be realized without the addition of an extraneous fuel but when a extraneous fuel is required, preferably a gaseous fuel would be introduced with the fluidizing gas through line 109.

In a more preferred embodiment of the present invention, at least a portion of the solid product will be heated to a temperature within the range from about 1600° F. to about 2400° F. and, in an effort to minimize calcining, this temperature will be reached either in a very short residence time or in the presence of a significant concentration of $CO_2$. When this is done, and referring again to FIG. 1, from about 1 to about 40 wt. % of the solids contained in the fluidized bed heater 107 pass through lines 111—111 to a separate heater 112. In general, any suitable heater could be used to further heat the solid product to a temperature above 1600° F. Due to sintering and fusion, however, it is preferred to effect this heating in a dilute phase transfer line as is illustrated in the figure. In the embodiment illustrated, then, a gas containing oxygen is introduced into line 111 and then heater 112 through line 113. The gas introduced through line 113 may contain any inert gaseous components and may also contain an extraneous fuel, preferably a gaseous fuel. In heater 112, the solid product is heated to a temperature between about 1600° F. and about 2400° F. through combustion of extraneous fuel added through line 113. As indicated, supra, the solid particles will either be heated quickly to the desired temperature or heated in the presence of a significant amount of $CO_2$. When $CO_2$ is not present, the temperature should be reached within a residence time from about 0.1 to about 10 seconds while longer residence times may be used with $CO_2$ partial pressures of at least 0.05 atmospheres in the heater. In any case, the particles will be cooled to a temperature below about 1600° F. prior to leaving the heater. Such cooling may be accomplished with cooler 114 located at or near the exit from the transfer line. The fluidizing gas, the gaseous combustion products and the heated solids are then withdrawn from the transfer line heater through line 115. The gaseous materials can then be withdrawn through line 116 and the heated solids returned to the fluidized bed heater 107 through lines 117—117. When operating in accordance with this embodiment, the temperature within heater 107 may be within the range from about 650° F. to about 1600° F. and preferably will be within the range from about 50° to about 400° F. above the temperature used in the retort. Heat to the retort will be supplied by passing hot solids from the fluid bed heater 107 to the retort through lines 118 and 103. The amount of solids recycled will be within the range from about 0.5 to about 20 lbs. per lb. of solid carbonaceous feed material to the retort. When operating in accordance with this embodiment of the present invention, the solids recycled to the retort will have a surface area within the range from about 0.0001 to about 50 $m^2/g.$, preferably 0.0001 to 2 $m^2/g.$, and the amount of fines contained in the product withdrawn through line 104 will range from about 0.1 to about 30 wt. %, preferably 0.1 to 2.0 wt. %.

In the embodiment thus described, the temperature of the solids in the fluidized bed heater will be controlled by varying the rate and composition of the fluidizing gas and the solids circulation rate between the retort and the heater. The rate of heat addition to the retort will be controlled by the actual temperature of the heater solids and the solid circulation rate between the heater and the retort.

Figure 2:
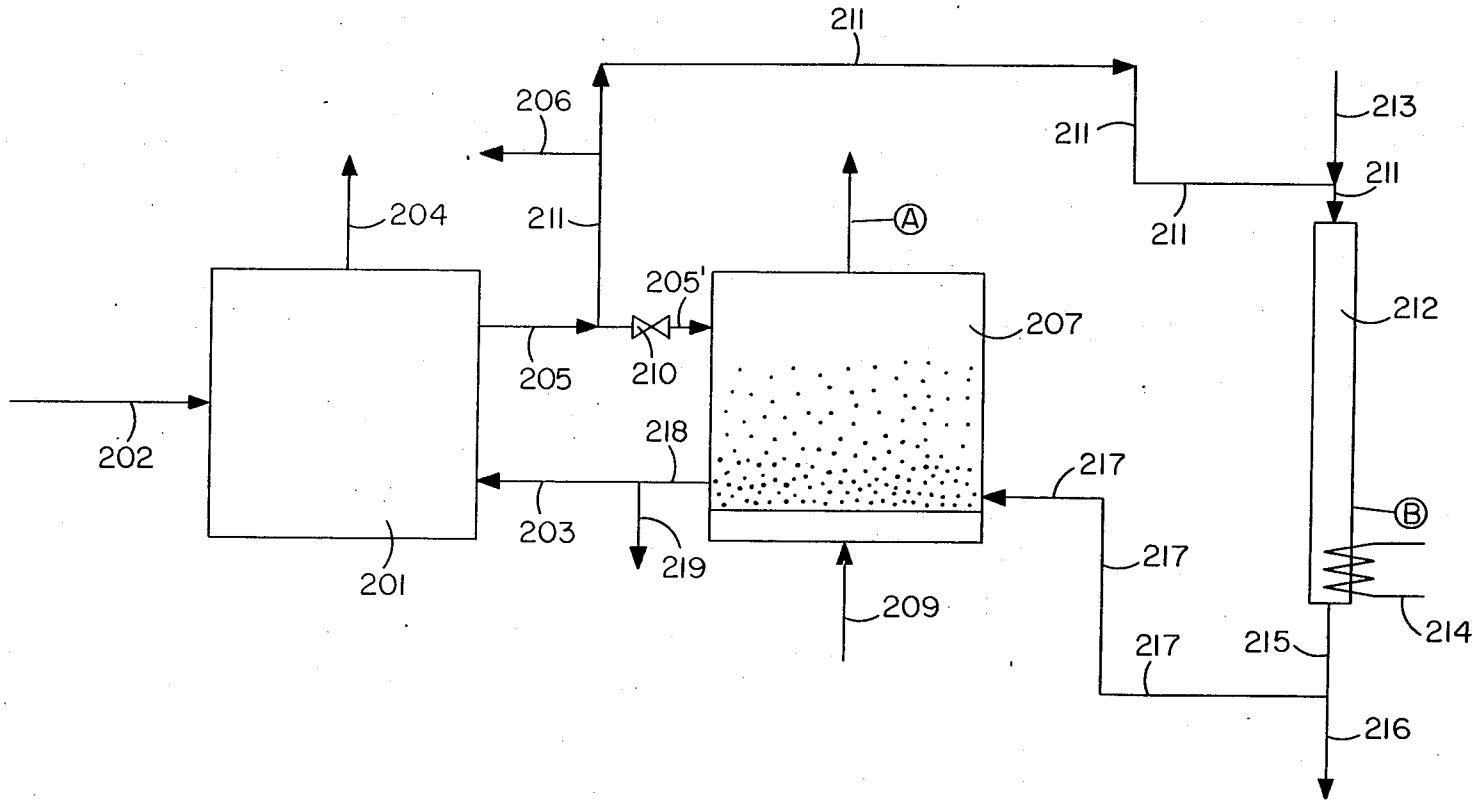
FIG. 2 is a schematic flow diagram of a process within the scope of the present invention wherein the solid product is brought to a temperature above its sintering or fusion temperature during the combustion step.

Referring now to FIG. 2, there is illustrated still another embodiment of the improved process of the present invention wherein the solid product from the retort, or at least a portion thereof, is passed directly to a transfer line heater where it is heated to a temperature within the range from about 1600° F. to about 2400° F. and then passed to a storage vessel prior to recycling to the retort. As illustrated in the figure, a solid carbonaceous material is passed to retort 201 through line 202. As in the case of the embodiment illustrated in FIG. 1, any suitable retort may be used in the improved method of the present invention. For example, the retort may be simply a transfer line retort, a fluidized bed retort, a screw-type retort or any combination thereof. As also indicated in the discussion of the embodiment illustrated in FIG. 1, when the retort is a fluid bed, the stripping action of the fluidizing gas will increase the amount of hydrocarbon taken overhead as product. In any case, the separation of gaseous and liquid products from the solid product will be accomplished in accordance with well known techniques and the same are not illustrated herein. In the embodiment illustrated in FIG. 2, the gaseous and liquid products are withdrawn overhead through line 204. Generally, these products may also comprise impurities as well as extraneous gases that may be used during the retorting such as a fluidizing gas. The overhead products may be cleaned up and undesirable constituents therein separated using technology well known in the prior art and these technologies do not form a part of the present invention.

In the embodiment illustrated in FIG. 2, the solid product is withdrawn from the retort 201 through line 205 and thence to a transfer line heater 212 through lines 211—211. In those embodiments wherein only a portion of the solid product is passed to the transfer line heater 212 and at least a portion of the solid product is passed directly to mixer 207, the amount passed to the mixer will be controlled and will flow through lines 205'—205'. The amount of solid withdrawn from 205 through 211 may vary from 0–100% of stream 205. Any excess solid product may be withdrawn through line 206 or line 219. Any excess solid product thus withdrawn may be burned separately to obtain the heating value thereof or discarded.

As in the case of the embodiment illustrated in FIG. 1, the transfer line heater 212 may be any suitable heater wherein the solid product may be heated to a temperature within the range from about 1600° F. to about 2400° F. Since sintering and/or fusion will occur at these temperatures, it is preferred that the heating be accomplished in a dilute phase transfer line heater; i.e., a heater wherein the solid material occupies from about 0.000001 to about 1% of the total volume of the heater. Operation in this manner will avoid agglomeration and the necessity of grinding of the recycle solid material. Grinding the agglomerated material, however, is within the scope of this invention.

In FIGS. 1 and 2, heaters 112 and 212 may be downflow, upflow, or horizontal configurations. In the heater 212, the solid product will be combined with a gas capable of supporting combustion and any extraneous fuel that may be necessary to achieve the desired temperature in the heater which is introduced into line 211 and thence heater 212 through line 213. Again, and so as to avoid calcining of various compounds contained in the solid product, the desired temperature should be reached in a residence time of from about 0.1 to about 10 seconds although longer residence times may be used when the gas introduced through line 213 also contains a significant amount of $CO_2$ and the heated solid material rapidly cooled so as to avoid agglomeration during subsequent transfer of the heated solids back to the retort. Cooling may be accomplished at the outlet of the transfer line heater with cooler 214. The heated solids and the flue gas may then be withdrawn through line 215, the flue gas withdrawn through line 216 and the solids passed to mixer 207 through lines 217—217.

In mixer 207, the hot solids will be mixed with any solid product passed directly to the mixer 207 through lines 205'—205' and the solids in the mixer will be held at a temperature within the range from about 50° to about 400° F. above the temperature employed in the retorting zone. In general, any type of mixer could be used to effect the desired mixing, however, a fluidized mixer as illustrated is preferred since this will facilitate mixing of the hot particles and subsequent transfer to the retort. When a fluidized mixer is employed, a fluidizing gas will be introduced through line 209. As an option, various amounts of $O_2$ or a fuel gas may be added through 209 to generate additional heat in 207. In this case, vessel 207 serves as a heater. Unconverted fluidizing gas and gaseous combustion products may be withdrawn through line A . Hot solids will be withdrawn from the mixer through 218. Excess hot solids may be withdrawn through line 219 and the remainder passed to the retort through 203. In general, hot solids will be introduced into the retort at a ratio within the range from about 0.5 to about 20 lbs. of hot solids per pound of solid carbonaceous material feed to the retort.

PREFERRED EMBODIMENT

In a preferred embodiment of the present invention, a shale rock will be retorted to produce a liquid, shale oil having an initial boiling point within the range from about 10° to about 30° C. and a final boiling point within the range from about 500° to about 700° C. In a preferred embodiment, from about 25 to about 75 wt % of stream 205 of the solid product will be heated to a temperature above the fusion point of the inorganic components contained therein and then recycled to the retort as a source of heat. The heating will be accomplished in a dilute phase transfer line heater wherein the solids occupy from about 0.00001 to about 0.1% of the total volume. After the particles have been heated to a temperature above the fusion point of the solid material, the heated solids will be cooled to a temperature within the range from about 50° to about 400° F. above the temperature employed in the retort and the same will be recycled to the retort at a ratio within the range from about 1 to about 5 lbs. of hot, recycle solids per lb. of shale rock feed to the retort.

Having thus broadly described the present invention and a preferred embodiment thereof, it is believed that the same will become more apparent by reference to the following examples. It will be appreciated, however, that the examples are presented solely for purposes of illustration and should not be construed as limiting the invention.

EXAMPLE 1

In this example a series of Fischer Assays were completed on an Australian shale from the Rundle region. In the first run of the series 80 gms of raw shale were used. In the second, approximately 67 gms of combusted spent shale were combined with 13 gms of raw shale. The combusted shale in this run had been combusted at a temperature of approximately 1600° F. and had a surface area of approximately 30 $m^2$/gm. In the third run approximately 67 gms of combusted shale which had been treated to reduce its surface area were combined with approximately 13 gm of raw shale. The treated, combusted shale had a surface area of 2 $m^2$/gm. In the first run the oil yield, based on raw shale was determined to be 100% of that available in a Fischer Assay and this was used as a base for purposes of comparison. In the second run the oil yield was only 70% of the theoretical Fischer Assay, based on raw shale. In the third run the oil yield was 100% of the theoretical Fisher Assay, based on raw shale. From this is believed apparent that oil yield can be increased by reducing the surface area of the combusted shale which is recycled as a source of heat.

EXAMPLE 2

In this example combusted Australian shale from the Rundle region which initially had a surface area of 30 $m^2$/gm was passed through a transfer line heater and contacted with air. The nominal particle holding time in the transfer line was within the range from about 1 to about 3 seconds. In the first run the temperature in the transfer line heater was about 2100° F. In the second run the temperature in the transfer line heater was about 2300° F. The fusion temperature of the combusted shale was determined to be somewhere within the range from about 1950° F. to about 2050° F. In the first run the surface area was reduced to a value within the range from about 5 to about 10 $m^2$/gm and in the second run the surface area was reduced to a value of less than 1 $m^2$/gm. From the foregoing, then it is believed readily apparent that the surface area of combusted shale can be significantly reduced by heating the same in accordance with the method of the present invention. This should in turn result in increased oil yields as illustrated in Example 1.

While the present invention has been described and illustrated by reference to particular embodiments thereof, it will be appreciated by those of ordinary skill in the art that the same lends itself to variations not necessarily illustrated herein. For this reason, then, reference should be made solely to the appended claims for purposes of determining the true scope of the present invention.

Having thus described and illustrated the invention, what is claimed is:

1. A process for retorting solid carbonaceous materials comprising:

(a) retorting a solid carbonaceous feedstock in a retorting stage at an elevated temperature in the presence of recycled solid heat carriers to produce at least a liquid product and a solid product containing residual carbon and inorganic material;

(b) heating at least a portion of said solid product in a first heating stage to a temperature within the range from about 650° F. to about 1600° F.;

(c) further heating from about 1 to about 40 wt % of the solids from step (b) in a second heating stage to a temperature above the sintering or fusion point of the inorganic material contained therein;

(d) recycling at least a portion of the solids from step (c) as solid heat carriers to step (a).

2. The process of claim 1 wherein said solids are heated to a temperature within the range from about 1600° F. to about 2400° F. in step (c).

3. The improvement of claim 2 wherein said separate heater is a transfer line heater.

4. The improvement of claim 2 wherein the solid product is heated to a temperature within the range from about 1600° F. to about 2400° F. within a period of from about 0.1 to about 10 seconds.

5. The improvement of claim 2 wherein the solid product is heated to a temperature of 1600° F. to about 2400° F. in the presence of added carbon dioxide.

6. The improvement of claim 5 wherein the partial pressure of carbon dioxide is within the range from about 0.05 to about 5 atmospheres.

7. A process for retorting solid carbonaceous materials comprising:

(a) retorting a solid carbonaceous feedstock in a retorting stage at an elevated temperature in the presence of recycled solid heat carriers to produce at least a liquid product and a solid product containing residual carbon and inorganic material;

(b) dividing said solids product into first and second portions;

(c) heating said first portion in a high temperature heating stage to a temperature above the sintering or fusion temperature of said solid product;

(d) passing said second portion into a mixing vessel wherein it is combined with said first portion after said first portion has been heated to a temperature above the sintering or fusing temperature of said solid product; and (d) recycling at least a portion of said mixture as solid heat carriers to step (a).

8. The process of claim 7 wherein said first portion comprises from about 25 to about 75 wt % of the solid product from step (a).

9. The process of claim 8 wherein said first portion is heated to a temperature within the range from about 1600° F. to about 2400° F. in step (c).

10. The improvement of claim 9 wherein the solid product is heated to a temperature within the range from about 1600° F. to about 2400° F. within a period of from about 0.1 to about 10 seconds.

11. The improvement of claim 9 wherein the solid product is heated to a temperature of 1600° F. to about 2400° F. in the presence of added carbon dioxide.

12. The improvement of claim 11 wherein the partial pressure of carbon dioxide is within the range from about 0.05 to about 5 atmospheres.

* * * * *